US010253974B1

(12) United States Patent
Lee

(10) Patent No.: US 10,253,974 B1
(45) Date of Patent: Apr. 9, 2019

(54) SYSTEM AND METHOD FOR BIOMASS COMBUSTION

(71) Applicant: Morgan State University, Baltimore, MD (US)

(72) Inventor: Seong W. Lee, Ellicott City, MD (US)

(73) Assignee: Morgan State University, Baltimore, MD (US)

( * ) Notice: Subject to any disclaimer, the term of this patent is extended or adjusted under 35 U.S.C. 154(b) by 510 days.

(21) Appl. No.: 15/056,179

(22) Filed: Feb. 29, 2016

Related U.S. Application Data

(60) Provisional application No. 62/121,843, filed on Feb. 27, 2015.

(51) Int. Cl.
*F23C 10/20* (2006.01)
*F23G 5/44* (2006.01)
(Continued)

(52) U.S. Cl.
CPC ..... *F23C 10/20* (2013.01); *F23G 5/30* (2013.01); *F23G 5/444* (2013.01); *F23G 5/46* (2013.01);
(Continued)

(58) Field of Classification Search
CPC ..... F23C 10/20; F23C 2900/10007; F26B 3/082; F23G 5/30
See application file for complete search history.

(56) References Cited

U.S. PATENT DOCUMENTS 2,818,935 A * 1/1958 Kemmetmuller ..... B04C 3/00 165/119
4,548,138 A * 10/1985 Korenberg ..... B01J 8/26 110/244
(Continued)

FOREIGN PATENT DOCUMENTS

EP 0458967 12/1991
WO 2010/010630 1/2010

OTHER PUBLICATIONS

Reichert, J. S., "Big chicken: Pollution and industrial production in America," ed. Washington DC: The PEW Environment Group, 2011.
(Continued)

*Primary Examiner* — David J Laux
(74) *Attorney, Agent, or Firm* — Whiteford, Taylor & Preston, LLP; Gregory M. Stone

(57) ABSTRACT

Disclosed is a system and method for the combustion of biomass material employing a swirling fluidized bed combustion (SFBC) chamber, and preferably a second stage combustion carried out in a cyclone separator. In the combustion chamber, primary air is introduced from a bottom air box that fluidizes the bed material and fuel, and staged secondary air is introduced in the tangential direction and at varied vertical positions in the combustion chamber so as to cause the materials in the combustion chamber (i.e., the mixture of air and particles) to swirl. The secondary air injection can have a significant effect on the air-fuel particle flow in the combustion chamber, and more particularly
(Continued)

Diagram of the Bubble-Cap Primary Air Distributor strengthens the swirling flow, promotes axial recirculation, increases particle mass fluxes in the combustion chamber, and retains more fuel particles in the combustion chamber. This process increases the residence time of the particle flow. The turbulent flow of the fuel particles and air is well mixed and mostly burned in the combustion chamber, with any unburned waste and particles being directed to the cyclone separator, where such unburned waste and particles are burned completely, and flying ash is divided and collected in a container connected to the cyclone separator, while dioxin production is significantly minimized if not altogether eliminated. The system exhaust is directed to a pollutant control unit and heat exchanger, where the captured heat may be put to useful work.

17 Claims, 5 Drawing Sheets

(51) Int. Cl.

| | |
|---|---|
| ***F23G 5/30*** | (2006.01) |
| ***F23G 5/50*** | (2006.01) |
| ***F23G 5/46*** | (2006.01) |

(52) U.S. Cl.
CPC ..... *F23G 5/50* (2013.01); *F23G 2200/00* (2013.01); *F23G 2203/50* (2013.01)

(56) References Cited

U.S. PATENT DOCUMENTS

| | | | | |
|---|---|---|---|---|
| 4,633,818 | A * | 1/1987 | Horlitz, Jr. | F22B 31/0038 105/43 |
| 4,867,079 | A * | 9/1989 | Shang | F23C 3/008 110/264 |
| 5,044,287 | A * | 9/1991 | Furukawa | F23C 9/003 110/188 |
| 5,105,917 | A | 4/1992 | Harada et al. | |
| 5,133,297 | A * | 7/1992 | Mansour | B01J 8/40 122/24 |
| 8,161,917 | B2 | 4/2012 | Yang et al. | |
| 2009/0314226 | A1* | 12/2009 | Higgins | F23C 10/10 122/4 D |

OTHER PUBLICATIONS

Gerber, P., C. Opio, and H. Steinfeld, "Poultry production and the environment—a review," in Poultry in the 21st century, ed Rome, Italy: Animal Production and Health Division, Food and Agriculture Organization of the United Nations, 2007.
Maheshwari, S., "Environmental impacts of poultry production," Poultry, Fisheries, and Wildlife Sciences, vol. 1, 2013.
Zhu, S., S. Lee and Y. Liu. Advanced swirling fluidized bed combustion (SFBC) process and unburned carbon analysis for biomass waste disposal, Carbon 2004 Conference, Jul. 11-16, Providence, Rhode Island, USA. ,2004.
Ongley, E. E., "Control of water pollution from agriculture," ed. Burlington, Canada: Food and Agriculture Organization of the United Nations, 1996.
Ribaudo, M., "Agricultural Resources and Environmental Indicators, 2006 Addition: Water quality impacts of agriculture," ed. Washington DC: U.S. Department of Agriculture, 2005.
Faaij, A., "Potential contribution of bioenergy to the world's future energy demand," ed. Rotorua, New Zealand: International Energy Agency, 2007.
Updated Capital Cost Estimates for Utility Scale Electricity Generating Plants, U.S. Energy In-formation Administration, Apr. 2013.
Granatstein, D.L. "Gasification Vs. Combustion of Waste/Biomass in Fluidized Reactors." Natural Resources Canada, CANMET Energy Technology Centre—Ottawa (CETC-O).
Renewable Energy Technologies: Cost Analysis Series, International Renewable Energy Agency, Jun. 2012.
Lee, S., "Design and Fabrication Method for Secondary Air Nozzles to SFBC", Morgan State University Laboratory Technical Report, 2009.
Lee, S., "Advanced Swirling Fluidized Bed Combustion Technology Applications", Morgan State University Technical Report, 2010.
Lee, S., "The Particle Characteristics and Analysis using the Laser-based Phase Doppler Particle Analyzer (PDPA) and Statistical Methods", Intl' Journal of Particulate Science and Technology, 2009, vol. 27(3), pp. 263-270.
Lee, S., G. Zhang, "Experimental Study and Simulation of the Flow Pattern of Gas and Particle in the Freeboard of the Swirling Fluidized Bed System", Proceedings of ASME Fluids Engineering Division, FEDSM97-3603, 1997.
Zhu S. and S. Lee, "Prediction of Combustion Efficiency of Chicken Litter using an Artificial Neural Network Approach", Intl' Journal of Fuel System,2009, Issue86/56, pp. 877-886.
Lee, S., S. Zhu and Y. Liu., Factorial Modeling for Transient Solid Particle Velocity in a Fluidized Bed Combustor Cold Model, Intl' Journal of Particulate Science & Technology 23, 205-214, 2005.
Zhu S. and S. Lee., Co-combustion performance of poultry waste and natural gas in the advanced swirling fluidized bed combustor (SFBC), Waste Management 25 (5), 508-515, 2005.

* cited by examiner

Diagram of the Bubble-Cap Primary Air Distributor

SYSTEM AND METHOD FOR BIOMASS COMBUSTION

CROSS REFERENCE TO RELATED APPLICATION

This application is based upon and claims benefit of U.S. Provisional Patent Application Ser. No. 62/121,843 entitled "Method and Design of the Ultra-Clean Mobile Combustor for Waste Biomass and Poultry Litter Disposal," filed with the U.S. Patent and Trademark Office on Feb. 27, 2015 by the inventor herein, the specification of which is incorporated herein by reference.

FIELD OF THE INVENTION

This invention relates to systems and methods for fluidized bed combustion, and more particularly to a fluidized bed combustion system and method optimized for burning biomass wastes and poultry litter in an environmentally-friendly manner.

BACKGROUND OF THE INVENTION

The consolidation and industrialization of the poultry industry over the last 50 years has resulted in highly concentrated regional poultry operations. Traditionally, farmers managed the manure or litter associated with poultry production by spreading it on fields. However, as the industry consolidated, operations became highly regionally concentrated, and cropland diminished, this waste disposal method became less viable. For example, in the Maryland-Delaware region, 523 million chickens are now produced annually, generating approximately 42 million cubic feet of chicken waste each year, such that chickens outnumber people in the region by as much as 400 to 1. This high concentration of waste causes eutrophication (e.g. nitrogen, phosphorus), particularly along the shores of the Chesapeake Bay, the largest estuary system in the United States, creating an urgent need for efficient, clean, environmentally friendly chicken waste disposal approaches.

The United Nations and The U.S. Federal Government have identified agriculture as the biggest user of water and a major polluter of water. In fact, agriculture has been identified as the single largest source of pollutants for rivers, lakes, and estuaries in the U.S. The industrialization of agriculture has resulted in such high concentrations of animal waste that conventional disposal methods are no longer adequate or viable (e.g. spreading on fields). Thus, there is an urgent need for environmentally safe and economically viable approaches to disposing of agricultural waste. This need in combination with global demand for clean, low-cost, renewable energy has fueled interest in biomass-to-energy conversion technologies, including for use in disposing of high concentrations of animal waste, which approach becomes even more appealing given recently implemented regulations that prohibit the use of chicken litter as fertilizer on significant acreage. However, due to the low energy density of biomass, the economics of biomass-to-energy operations have been challenging (i.e., fuel collection and transportation costs can be high relative to energy density; high moisture content adds to transportation costs and reduces burn efficiencies). Thus, there remains a need for solutions that can reduce the cost of converting biomass to energy and/or increase the efficiency of the combustion process.

Fluidized bed combustion systems are often used for burning biomass fuel. Most of the existing fluidized bed combustion apparatus known to the inventor have only a single level secondary injection of air in the fixed tangential direction to facilitate a turbulent or swirling flow, as shown in U.S. Pat. No. 5,105,917 to Harada et al., and in U.S. Pat. No. 8,161,917 to Yang et al., the specifications of which are incorporated herein by reference in their entireties. Certain systems disclose multiple secondary air supply ports, such as the system shown in European Patent Publication No. 0 458 967 A1. Still other systems disclose methods for incinerating waste using a two-level swirling flow fluidized bed without tangential flow for suppressing re-synthesis of dioxins produced during incineration and the removal of a suspended particulate material, such as the system disclosed in International PCT Publication No. WO/2010/010630. The specifications of each of the foregoing references are incorporated herein by reference in their entireties. However, widespread commercial acceptance of such prior systems has been lacking, due to an inability to reach sufficiently high combustion efficiencies and minimization of noxious emissions. Thus, there remains a need in the art for fluidized bed combustion systems and methods capable of efficiently and cleanly disposing of biomass materials.

SUMMARY OF THE INVENTION

Disclosed is a system and method for ultra-clean and preferably mobile combustion, particularly configured for burning biomass and poultry litter in an environmentally friendly manner (i.e., so as to reduce emissions of pollutants), which system and method provides high combustion efficiency using equipment of compact design and that is easy to operate.

In accordance with certain aspects of an embodiment of the invention, the system carries out preferably a two-step combustion process, namely, a first stage combustion carried out in an advanced swirling fluidized bed combustion (SFBC) chamber, and a second stage combustion carried out in a cyclone separator. In the combustion chamber, primary air is introduced from a bottom air box that fluidizes the bed material and fuel, and staged secondary air is introduced in the tangential direction and at varied vertical positions in the combustion chamber so as to cause the materials in the combustion chamber (i.e., the mixture of air and particles) to swirl. The secondary air increases the residence time of the particle flow. The turbulent flow of the fuel particles and air is well mixed and mostly burned in the combustion chamber. Any waste and particles that remain unburned in the combustion chamber are directed to the cyclone separator, where such unburned waste and particles are burned completely, and flying ash is divided and collected in a container connected to the cyclone separator, while dioxin production is significantly minimized if not altogether eliminated. The collected ash and char may optionally be used as fertilizer. The system exhaust, in the form of high temperature flue gas, is directed to a pollutant control unit and heat exchanger, where the captured heat may be put to useful work, such as by generating steam for delivery to a turbine, powering a Sterling engine, or such other energy generation devices as may be apparent to those skilled in the art, or for direct heating of process materials, such as water, feed stock (for drying the same), or the like, or such other direct heat application processes as may be apparent to those skilled in the art.

The system and method set forth herein have the potential to significantly improve the economics of biomass-to-energy operations, by dramatically improving the efficiency of the combustion process while reducing capital and operating costs. The single chamber design in comparison to the classic combustor system with multiple chambers contributes to lower capital costs. This novel system yields a more efficient burn rate and less solid and gaseous waste than conventional systems for biomass waste disposal.

Relative to other biomass combustion systems, the system and method disclosed herein is expected to have a higher electrical output, lower capital cost, lower maintenance costs, and greater flexibility regarding fuel sources and conditions. Thus, the system and method set forth herein has the potential to significantly improve the economics of biomass-to-energy operations. In a particularly preferred embodiment, a system and method operating in accordance with the disclosure herein would have a commercial electrical power rating of 50 MWe, would carry a capital cost of \$3,000-\$3,200 per kW, and would carry operating and maintenance costs of \$15-\$20/ton of feed, thus offering a clean, high efficiency, and affordable method to dispose of biomass and poultry litter while generating energy.

In accordance with certain aspects of an embodiment of the invention, a system for fluidized bed combustion is disclosed comprising a combustion chamber, the combustion chamber further comprising: a primary air distribution and delivery system configured to provide vertical airflow through the combustion chamber; and a secondary air distribution and delivery system configured to provide a plurality of vertically displaced, horizontally aligned, tangential airflows in the combustion chamber; and a biomass feeder in communication with an interior of the combustion chamber and positioned to deliver biomass material to the interior of the combustion chamber at a location above the primary air distribution and delivery system and below the secondary air distribution and delivery system.

In accordance with further aspects of an embodiment of the invention, a method for fluidized bed combustion is disclosed, comprising the steps of: providing a combustion chamber, the combustion chamber further comprising: a primary air distribution and delivery system configured to provide vertical airflow through the combustion chamber; and a secondary air distribution and delivery system configured to provide a plurality of vertically displaced, horizontally aligned, tangential airflows in the combustion chamber; providing a biomass feeder in communication with an interior of the combustion chamber and positioned to deliver biomass material to the interior of the combustion chamber at a location above the primary air distribution and delivery system and below the secondary air distribution and delivery system; directing biomass from the biomass feeder to the combustion chamber; directing a vertical primary airflow into the combustion chamber and multiple, vertically displaced tangential airflows into the combustion chamber to create a swirling fluidized bed of biomass particles in the combustion chamber; and maintaining a biomass feed rate from the biomass feeder, a primary airflow rate from the primary airflow, and a secondary airflow rate from the tangential airflows sufficient to maintain a combustion efficiency of at least 90%.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
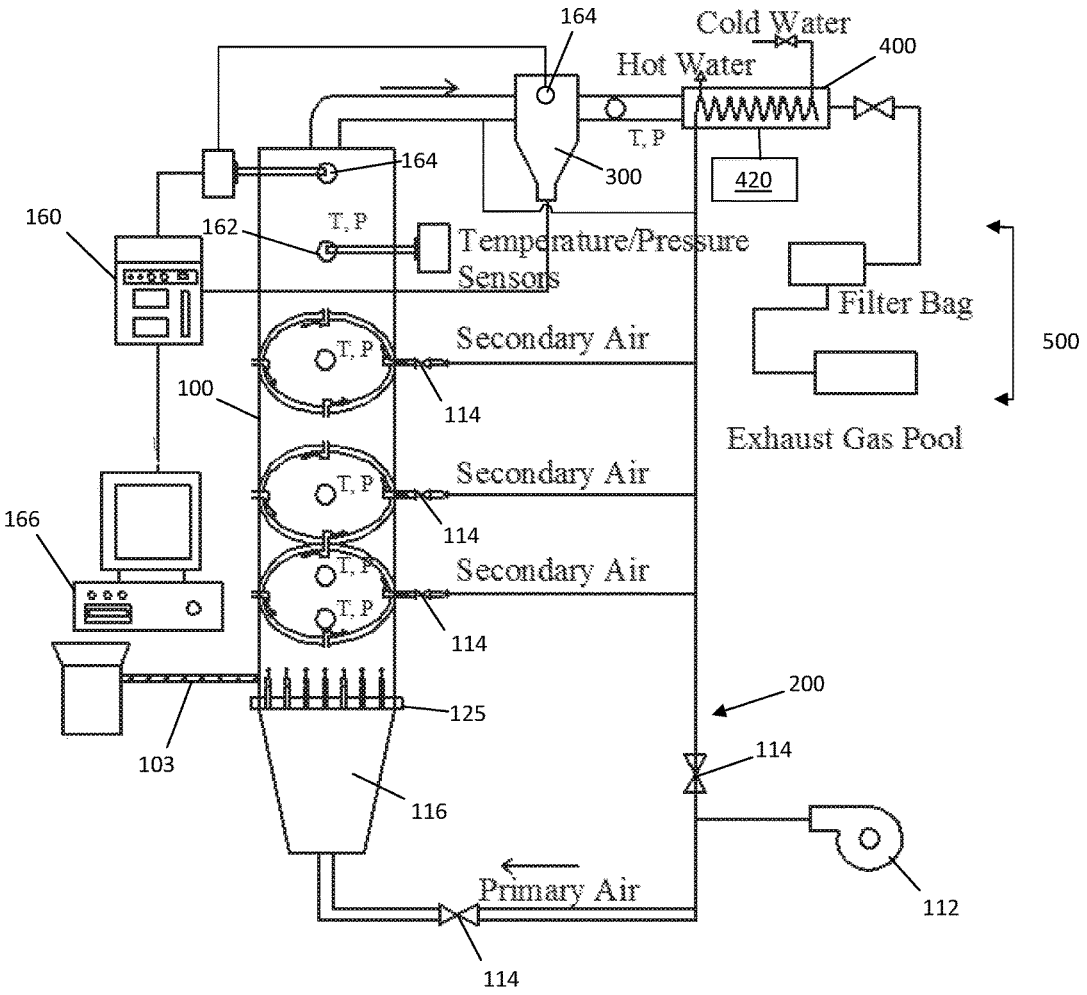
FIG. 1 is a schematic view of a system for burning biomass in accordance with certain aspects of an embodiment of the invention.

FIG. 1 shows a schematic view of a system for burning biomass in accordance with certain aspects of an embodiment of the invention, including a combustion chamber 100, air delivery system (shown generally at 200), a cyclone separator 300, a heat exchanger 400, and exhaust system 500. Optionally, the entire system may be housed on a mobile chassis (not shown) so that the system may be moved from site to site for processing of biomass at the site of production or collection of the biomass.

Combustion chamber 100 includes a generally cylindrical housing having preferably a metal exterior and a refractory layer on an interior surface of the metal exterior. A primary air distribution and delivery system 110 is provided in the bottom of the combustion chamber 100, and receives high pressure air from air delivery system 200, in turn directing that air toward the top of the combustion chamber in order to vertically distribute the biomass/fuel and diffuse particles throughout the column in the combustion chamber 100. Moreover, secondary air distribution and delivery system 130 includes multiple, vertically displaced rows of nozzles, discussed in greater detail below, which nozzles are configured to provide controllable, multi-angle air-injection at multiple, distinct vertical levels within combustion chamber 100 to provide a swirling flow in the column, which in turn maximizes combustion throughout the combustion chamber 100.

A fuel feeder 102 is provided adjacent combustion chamber 100, and may be provided, by way of non-limiting example, a hopper for receiving biomass, poultry litter, and other materials that might be used for fuel in the combustion chamber 100, and a delivery mechanism 103, such as a feed screw, configured to deliver such biomass/fuel from fuel feeder 102 to combustion chamber 100. Such biomass/fuel is delivered into combustion chamber 100 at a point above primary air distribution and delivery system 110, and below secondary air distribution and delivery system 130. The solid biomass/fuel is supplied tangentially into the combustion chamber 100, such that no bed material is required. The airflow from the primary air distribution and delivery system 110 and from the secondary air distribution and delivery system 130 act as both particle fluidizers and combustion oxidizers. The multiple levels of nozzles of secondary air distribution and delivery system 130 provide extended swirl flow along with additional air (e.g., oxygen supply). This configuration retains particles in the combustion zone, reducing unburned particles and thus minimizing residual material. The extended swirling flow generated by the system results in vigorous particle-to-wall collisions, which increases the residence time and combustion efficiency of fuel particles in the combustion zone.

A natural gas feed 104 is preferably positioned to feed natural gas into combustion chamber 100 above primary air distribution and delivery system 110. Natural gas is preferably used only to initiate the burn at startup in order to achieve the initial biomass ignition. Further, monitoring and control subsystem 160 is provided, which preferably includes temperature and pressure sensors 162 within combustion chamber 100, one or more particulate matter (PM) meters and emissions probes 164 capable of monitoring both levels of particulates and gaseous emissions (including NOx, SOx, CO, and $CO_2$), which sensors and probes are readily commercially available such that their specific configuration is not addressed further here. Likewise, those skilled in the art will recognize that additional process control accessories may be provided as may be suitable for a particular installation. Monitoring control subsystem 100 is also in electrical communication with, and thus is configured to provide control signals to, delivery mechanism 103 from fuel feeder 102 (e.g., by controlling a motor driving a feed screw of delivery mechanism 103) to control the amount of biomass/fuel delivered to combustion chamber 100, to a blower 112 to control the amount of air delivered through primary air distribution and delivery system 110 and through secondary air distribution and delivery system 130, and preferably to valves 114 to allow independent control of the amount of air delivered through such systems 110 and 130 with respect to one another. Alarm levels may be established for monitored data, which alarm levels are preferably set by a person using data processing equipment 166 responsible for configuring the system. As an alarm relay is activated, the monitoring and control subsystem 160 is configured to decrease the fuel feeding rate through preferably a variable speed controller, reducing such feed rate to a point necessary to have the particulate matter levels below the set alarm relay levels. Likewise, monitoring and control subsystem 160 controls the amount of air delivered through primary air distribution and delivery system 110 and through secondary air distribution and delivery system 130 (through control of blower 112 and valves 114 in air delivery system 200) so as to control the burn rate in combustion chamber 100. All of these factors may be controlled so as to maintain the safest possible burn rate so as to maintain emissions within a desired range and so as to ensure a maximum efficiency in biomass combustion is maintained.

With continued reference to FIG. 1, exhaust from combustion chamber 100 is directed to a cyclone separator 300. As will be discussed in further detail below, any waste and particles that remain unburned in combustion chamber 100 are directed to the cyclone separator 300, where such unburned waste and particles are burned, and flying ash is divided and collected in a container connected to the cyclone separator, while dioxin production is significantly minimized if not altogether eliminated. The collected ash and char may optionally be used as fertilizer. The system exhaust, in the form of high temperature flue gas, is directed from cyclone separator 300 to a heat exchanger 400 and an exhaust system 500 including a pollutant control unit. Heat captured by heat exchanger 400 may be put to useful work through use of any thermal energy conversion device 420 as may be deemed appropriate for a given installation by persons of ordinary skill in the art, such as by way of non-limiting example by generating steam for delivery to a turbine, powering a Sterling engine, or such other energy generation devices as may be apparent to those skilled in the art, or for direct heating of process materials, such as water, feed stock (for drying the same), or the like, or such other direct heat application processes as may be apparent to those skilled in the art.

Figure 2:
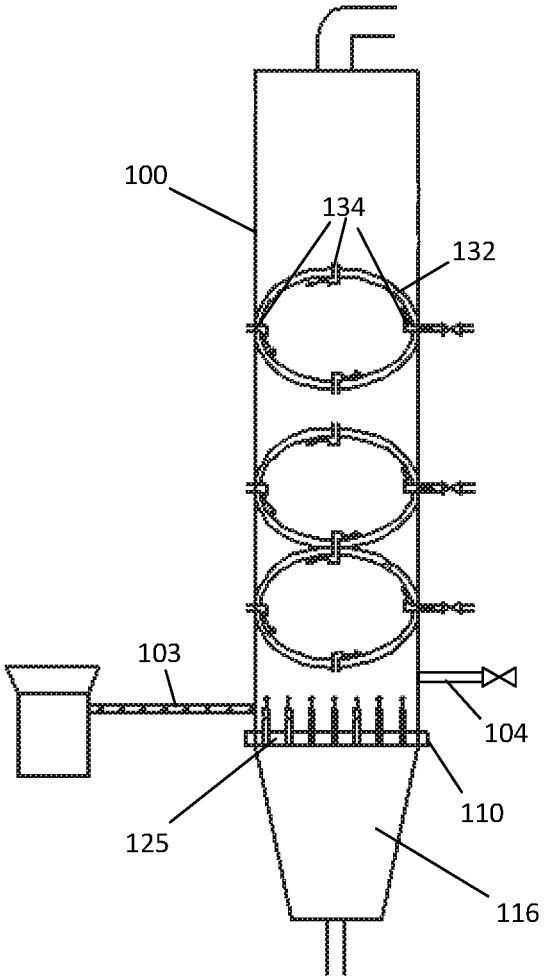
FIG. 2 is a close-up, cross-sectional view of a combustion chamber used in the system of FIG. 1.
Figure 3:
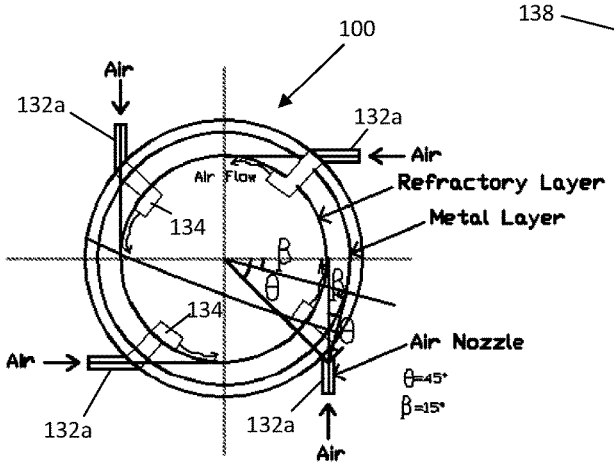
FIG. 3 is a top, cross-sectional view of the combustion chamber of FIG. 2.

FIG. 2 provides a front, cross-sectional view of combustion chamber 100, while FIG. 3 provides a top, cross-sectional view of combustion chamber 100. As shown in FIGS. 1-3, combustion chamber 100 includes a primary air box 116 that receives primary air from blower 112, and directs such primary air to primary air distribution and delivery system 110. Primary air distribution and delivery system 110 directs primary air into combustion chamber 100, where such primary air receives natural gas through natural gas feed 104 and biomass/fuel from delivery mechanism 103, both igniting the biomass as it enters combustion chamber 100 and causing it to flow upward in combustion chamber 100. As such biomass flows upward through combustion chamber 100, it encounters secondary air distribution and delivery system 130, which in turn comprises two or more airflow manifolds 132, each of which receives air from air delivery system 200. Each airflow manifold 132 directs secondary air to a plurality of secondary air injection nozzles 134 positioned around an interior circumference of combustion chamber 100. In a particularly preferred embodiment, four air injection nozzles 134 are provided at a common height on the interior of combustion chamber 100, and are spaced evenly along the interior circumference of combustion chamber 100 at that common height. The secondary air injection nozzles 132 control the direction of the injected secondary air into combustion chamber 100, injecting such secondary air at various angles so as to cause the particles and air in combustion chamber 100 to achieve a swirling effect so as to increase combustion of the biomass in combustion chamber 100.

As best shown in the top, cross-sectional view of FIG. 3, air nozzles **132*a* may be provided along an exterior of combustion chamber 100 that receive secondary air from airflow manifolds 132, and deliver such secondary air to each secondary air injection nozzle 134. Each secondary air injection nozzle 134 has a first branch that extends radially through both an exterior metal layer 150 of combustion chamber 100 and an internal refractory layer 152 lining an interior of combustion chamber 100. An interior branch of each air injection nozzle 132 is arranged at approximately 90° to each respective first branch so as to position the outlet of secondary air injection nozzle 134 to direct secondary air tangentially along the interior of refractory layer 152 of combustion chamber 100, in turn creating a swirling effect on the interior of combustion chamber 100**.

Figure 4:
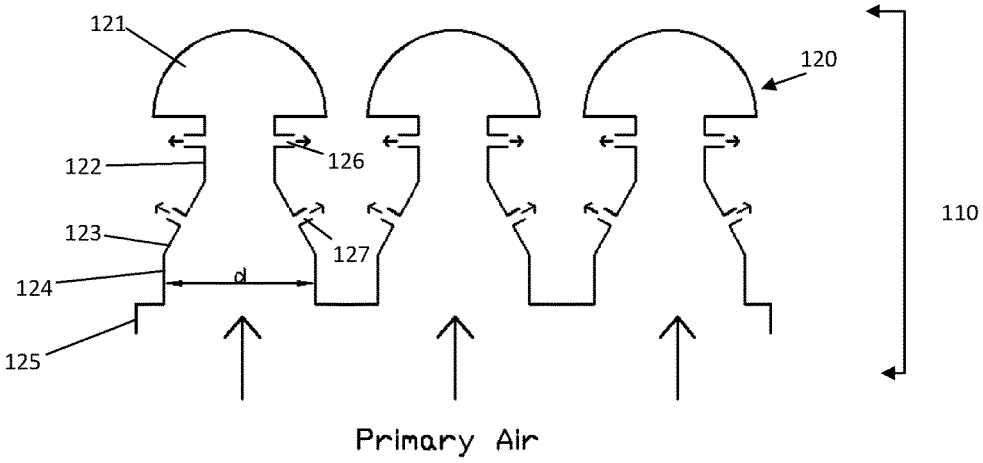
FIG. 4 is a side view of primary airflow nozzles for use in the combustion chamber of FIG. 2.

As shown in the side view of primary air distribution and delivery system 110 of FIG. 4, the primary air distribution and delivery system 110 includes a plurality of primary nozzles 120, which nozzles 120 are particularly configured to maximize air distribution at the bottom of combustion chamber 100. Each nozzle 120 has a rounded, semi-circular head 121, a cylindrical branch 122 extending downward from head 121, and an outwardly extending lower branch 123 that has a widening diameter as it extends from cylindrical branch 122 to base portion 124, which base portion 124 comprises the widest diameter d for each nozzle 120. Base portion 124 receives air directly from primary air distribution and delivery manifold 125, which extends horizontally along the bottom portion of combustion chamber 100, receiving air from primary air box 116. In certain configurations, a plurality of manifolds 125 may extend horizontally across the bottom of combustion chamber 100 so as to provide even distribution of nozzles 120 across the full width of combustion chamber 100.

With continued reference to FIG. 4, horizontally extended outlets 126 are positioned on each cylindrical branch 122, and upwardly angled outlets 127 are positioned on each lower branch 123, for feeding air from primary air distribution and delivery system 100 into combustion chamber 100. In a particularly preferred embodiment, each primary nozzle 120 includes four horizontally extended outlets 126 and four upwardly angled outlets 127. In a prototype construction implementing the system and methods described herein (described in greater detail below), a total of 24 outlets 126 were provided, each having a diameter d of ⅛ inch. In an embodiment of the invention, openings formed by horizontally extended outlets 126 and upwardly angled outlets 127 comprise 2% of the overall surface area of the primary air distributors.

Figure 5:
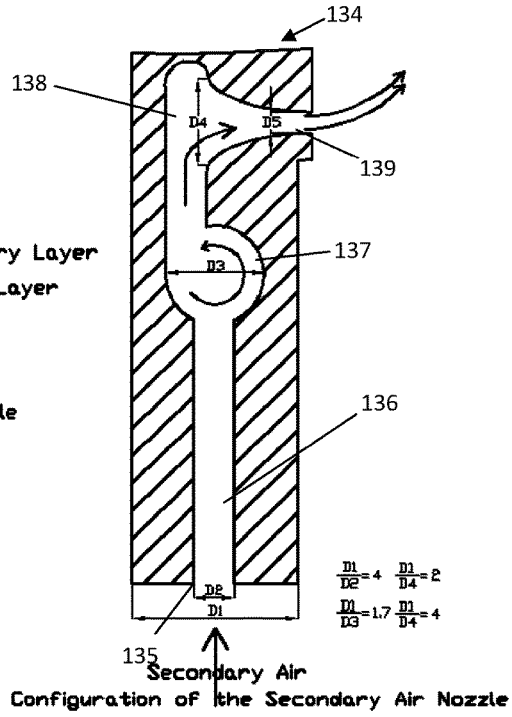
FIG. 5 is a cross-sectional view a secondary airflow nozzles for use in the combustion chamber of FIG. 2.

Similarly, and with reference to the cross sectional view of secondary air injection nozzles 134 of FIG. 5, both the shape and axial position of secondary air nozzles 134 are important to providing proper air and material flow within combustion chamber 100. More particularly, secondary air injection nozzles 134 function to change the direction of the supplied secondary air so as to cause a swirling flow condition inside of combustion chamber 100. As mentioned above, sets of preferably four, evenly circumferentially spaced secondary air injection nozzles 134 are provided at at least two, and preferably three, distinct heights on the interior of combustion chamber 100. In the prototype construction described above, the bottom-most set of secondary air injection nozzles 134 were positioned 34 inches from the bottom of the combustion chamber and primary air distribution manifold 125, with the subsequent higher sets of secondary air injection nozzles 134 each evenly spaced 10-11 inches above the next-lowest set. In any configuration, the position and number of secondary air injection nozzles will generally be determined by the height of the combustion chamber 100 above air box 116, with horizontally aligned sets of secondary air injection nozzles 134 being positioned equidistant to one another. It has been found that at least three horizontal sets of secondary air injection nozzles 134 are most preferred in order to ensure that an optimal biomass material residence time is maintained for the biomass particles undergoing combustion. The higher the number of second air injection nozzles 134, the higher the oxygen supply into the combustion chamber 100, which in turn increases the swirling effect on the fluidized bed and a resulting high combustion efficiency above 90%.

Each secondary air injection nozzle 134 includes inlet 135 that receives secondary air from an airflow manifold 132. Inlet 135 opens into inlet channel 136, which in turn directs secondary air into a centrally located, circular chamber 137. An interior flow channel 138 extends from chamber 137, and at a distal end directs the airflow through nozzle outlet 139, which outlet 139 extends at generally 90° to a flow axis of both inlet channel 136 and interior flow channel 138, in turn introducing air into combustion chamber 100 in a tangential direction so as to cause swirling air flow. This configuration has been found to provide a swirling air flow from the secondary air injection into combustion chamber 100, which in turn forms the particle suspension layer and dilution zone within combustion chamber 100. Through adjustment of the secondary air injection through secondary air injection nozzles 134 configured in this manner, the axial position of the particle suspension layer within combustion chamber 100 can be closely controlled.

The resulting strong swirling air flow field in combustion chamber 100, in combination with the interaction of centrifugal forces and gravity on the particles in combustion chamber 100, cause larger particles to be kept in combustion chamber 100 for a significant amount of time, in turn contributing to high combustion efficiency and extremely low emissions. The swirling particle flow in combustion chamber 100 can be described by stochastic trajectory modeling (STM), and the diffusion-kinetics model can be used for predicting fuel materials depletion during the combustion process to describe the residence time of particles in combustion chamber 100, which modelling techniques are known to those of ordinary skill in the art. These techniques may, in turn, be used to control biomass feed rate and airflow through primary air distribution and delivery system 110 and secondary air distribution and delivery system 130 to effect residence time and the overall combustion process in combustion chamber 100. By way of non-limiting example, in the exemplary prototype construction described below, biomass material residence time in combustion chamber 100 would preferably be in the range of 2-5 seconds with combustion temperatures of 1400-1700° F.

Figure 6:
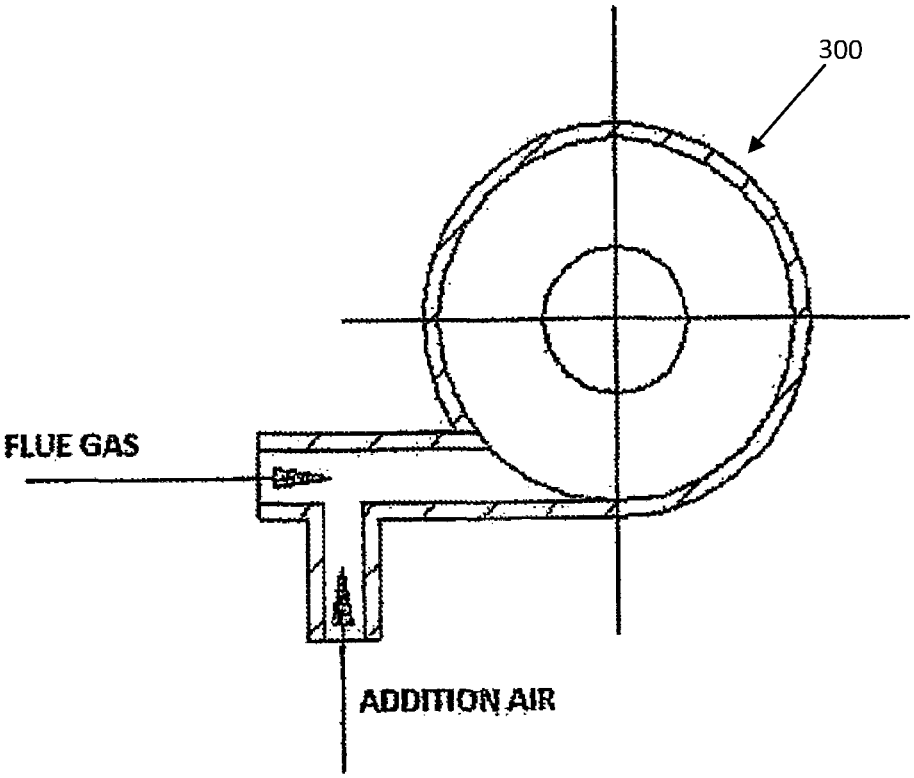
FIG. 6 is a top, cross-sectional view of a cyclone separator used in the system of FIG. 1.

FIG. 6 is a top, cross-sectional view of the cyclone combustor 300, having an air inlet 302 that receives flue gas from combustion chamber 100 and fresh air from air delivery system 200. The high temperature flue gas directed to cyclone combustor 300 may contain unburned carbon particles. As shown in FIG. 6, fresh air is added into the flue gas before it enters the cyclone combustor 300. In this configuration, the unburned carbon particles and oxygen in the fresh air will bum again in the cyclone combustor 300. In addition to re-burning the unburned carbon, the cyclone combustor 300 functions as a particle separator in which the coarse particles will fall down to a particle collector. The flue gas is therefore preliminarily cleaned through the cyclone, before it is passed on to heat exchanger 400 and exhaust system 500.

As mentioned above, heat exchanger 400 may be employed to put heat captured from the flue gas from combustion chamber 100 to useful work. For example, such heat exchanger 400 may be used to produce electricity through employment of a Sterling engine or through steam generation to drive a turbine. Moreover, heat exchanger 400 may be used for direct heating of water, for drying of materials (including drying of biomass material that is to be processed through combustion chamber 100 before its introduction into combustion chamber 100), or for heating of spaces for workers, consumers, livestock, or the like.

After heat exchanger 400, the flue gas may be directed to exhaust system 500, which may include (by way of non-limiting example) a filter bag or other filter housing, and an exhaust stack or exhaust gas pool of standard configuration.

The foregoing system may be used to process a wide variety of biomass material, including (by way of non-limiting example) poultry litter, municipal solid waste, agricultural waste, algae waste, biomedical hazard waste, and the like. Moreover, sawdust, wood chips, wood pellets, switch grass, dried leaves, corn husks, rice shells, and such other biomass materials as may be selected by those skilled in the art may similarly be processed by the foregoing system to produce high heat and energy.

The foregoing system may be particularly well suited to processing of poultry litter. While total poultry litter production on a given poultry farm will determine feed rate of materials to combustion chamber 100, in a particularly preferred configuration, poultry litter may be directed to combustion chamber 100 at a feed rate of 40-60 lb/hr. Operating at a schedule of 20 hours/day, 6 days/week, and 52 weeks/year, such a feed rate can process approximately 300,000 pounds of poultry litter each year. In processing such poultry litter (as well as other biomass materials), it will be important to monitor and regulate moisture of the feedstock to ensure proper combustion in combustion chamber 100. Particularly for poultry litter, a desired practical moisture level is between 15% and 35%, and above this range, pre-drying will be required for combustion to proceed efficiently in combustion chamber 100. Of course, feedstock may certainly have a lower moisture content and achieve proper combustion in combustion chamber 100, such that an overall operational target is for moisture content of any biomass material to be generally below 35%.

Figure 7:
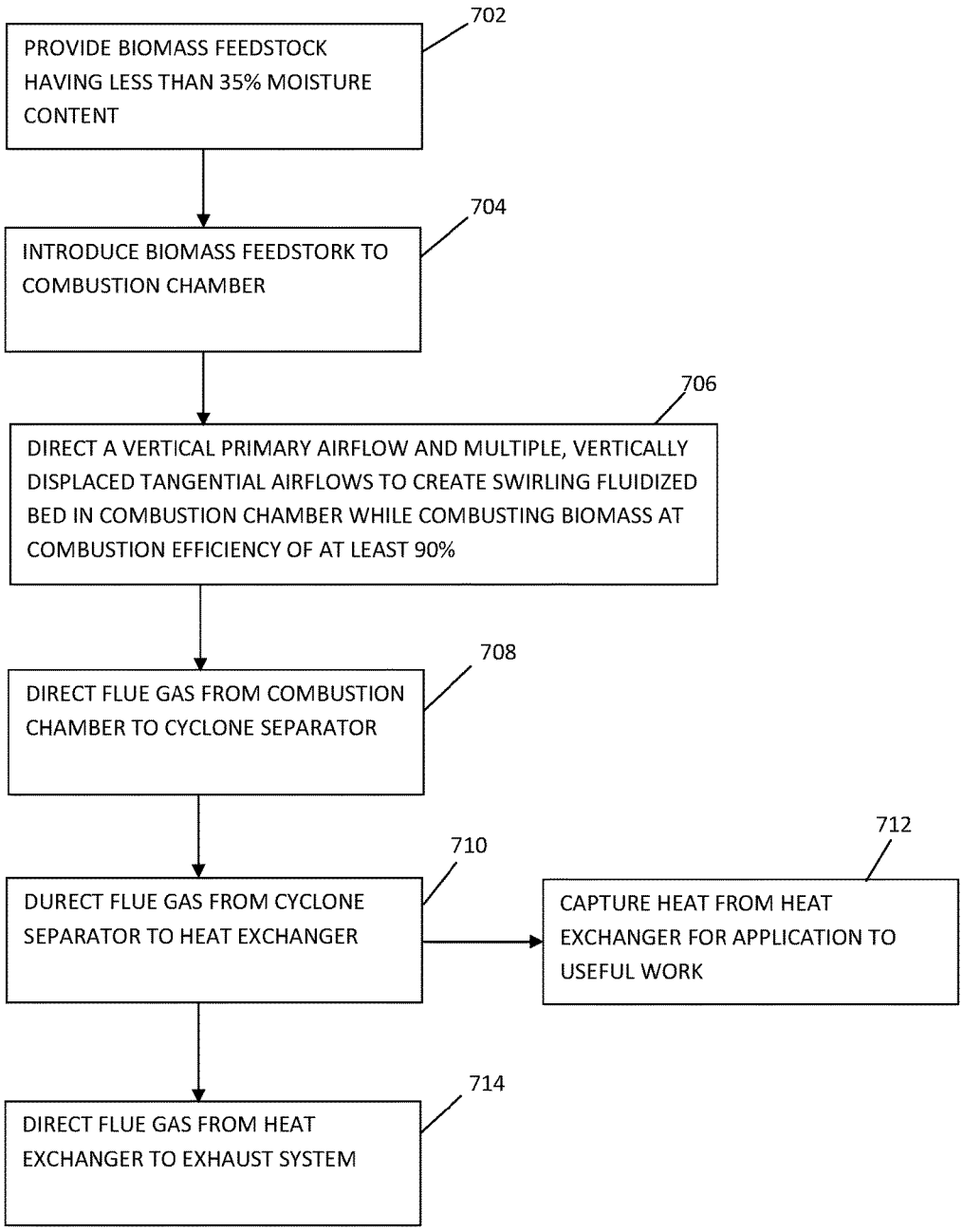
FIG. 7 is a flowchart depicting a method for burning biomass in accordance with certain aspects of an embodiment of the invention.

In accordance with certain aspects of the invention, a method for processing biomass material may comprise the steps shown in FIG. 7. At step 702, biomass feedstock is provided having a moisture content that is general less than 35%. In the event that such biomass has a moisture content higher than 35%, predrying of such biomass material should be carried out to reduce the moisture content. Next, at step 704, such biomass material is introduced into a combustion chamber 100 of a biomass combustion system configured as detailed above. As the biomass material is being introduced into combustion chamber 100, as noted at step 706, a vertical primary airflow is directed into combustion chamber 100, while multiple, vertically displaced tangential airflows are introduced into combustion chamber 100, so as to create a swirling fluidized bed of the biomass particles in combustion chamber 100, with the biomass particles being combusted at a combustion efficiency of at least 90%. At step 708, flue gas from the combustion chamber is directed to a cyclone separator configured as above, where any unburned waste and particles that were unburned in the combustion chamber are burned completely, and flying ash is divided and collected in a container connected to the cyclone separator, while dioxin production is significantly minimized if not altogether eliminated. The collected ash and char may thereafter optionally be used as fertilizer. Next, at step 710, the system exhaust (in the form of high temperature flue gas) is directed to a heat exchanger, and at step 712 the heat captured from the heat exchanger is put to useful work, such as by generating steam for delivery to a turbine, powering a Sterling engine, or other such other energy generation devices as may be apparent to those skilled in the art, or for direct heating of process materials, such as water, feed stock (for drying the same), or the like, or such other direct heat application processes as may be apparent to those skilled in the art. Finally, at step 714, the flue gas is directed from the heat exchanger to the exhaust system with significantly reduced noxious emissions, and more particularly having $NO_x$ of less than 80 ppm, $SO_x$ of less than 20 ppm, $CO_2$ of less than 2%, and particulate matter content of less than 3 lb/MM Btu.

Example 1

A lab-scale prototype of the system described above was designed and built by the Lee Research Group at The Center for Advanced Energy Systems and Environmental Control Technologies (CAESECT) at Morgan State University in Baltimore, Md. The lab prototype system can process 11-24 lb/hr of pre-dried poultry litter with high combustion efficiency (over 96%) without co-combustion or bed materials. The poultry litter was burned in a well-controlled environment at a temperature low enough (1,400-2,100° F.) to avoid formation of nitrogen oxides, but high enough to avoid agglomeration and slagging in the ash. Milestones for efficiency, ultra-clean emissions, and particular matter were set as follows: $NO_x$ (30-80 ppm), $SO_x$ (15-20 ppm), $CO_2$ (1.5-2.0%), and particulate matter (2.0-2.5 lb/MM Btu). The residual fly ash (i.e., phosphate $P_2O_5$ and potassium, $K_2O$) is a high value fertilizer. The results produced from the prototype configuration indicate improved performance characteristics over other combustion technologies, as shown in Table 1 below.

TABLE 1

Comparison of System with Other Combustion Technologies

| | Stoker* | BFBC* | CFBC* | System According to Aspects of the Invention |
|---|---|---|---|---|
| Firing Capacity | Small/ Medium | Small/ Medium | Medium/ Large | Small/ Medium |
| Combustion Efficiency (%) | =80% | 80-90% | 85-94% | Above 95% |
| $SO_x$ Removal in combustor | None | Sorbent in bed | Sorbent in bed/ freeboard | Optional |
| $NO_x$ Emissions | High | Low | Very low | Very low |
| Ash Form | Bottom ash | Bottom ash | Bottom ash | Fly ash |
| Combustion Temperature | 1,300 | 850-950 | 850-1000 | 850-1,250 |
| Primary Air Fraction (%) | 100 | 100 | >80 | 10-50 |
| Mean Gas-Particle Slip Velocity (m/s) | None | 0.2 | 0.5-1.0 | 1-5 |
| Turbulence in Combustor | None | Good | Excellent | Excellent |

*Stoker-Fired Combustor, BFBC-Bubbling Fluidized Bed Combustor (FBC), CFBC-Circulating FBC, SFBC In order to achieve the foregoing benefits, the prototype system was configured as detailed in Table 2 below:

Combustor Dimensions

| | Component Description | Units (in) | Units (cm) |
|---|---|---|---|
| 1 | Combustor Outer Diameter ($d_{cod}$) | 15.12 | 38.4048 |
| 2 | Combustor Internal Diameter ($d_{cid}$) | 13.72 | 34.8488 |
| 3 | Refractory Material Thickness ($t_r$) | 0.7 | 1.778 |
| 4 | Fuel Feeder Diameter ($d_f$) | 2.9 | 7.366 |
| 5 | Primary Air Inlet Diameter ($d_p$) | 3.5 | 8.89 |
| 6 | Secondary Air Inlet Diameter ($d_s$) | 0.46 | 1.1684 |
| 7 | Total Combustor Height (H) | 74 | 187.96 |
| 8 | Air Box Height ($H_a$) | 13 | 33.02 |
| 9 | Combustion Chamber Height ($H_c$) | 61 | 154.94 |

The prototype configuration was provided one primary port and 12 secondary ports. The primary air was injected from the bottom of the chamber. The heights of secondary air nozzles were 34, 45 and 55.5 inch respectively. The feeding rate for the prototype configuration was 11-24 lb/hr. The air flow rate for primary air was 49-110 cfm, and for secondary air was 6-16 cfm. The temperature during poultry litter combustion was between 1,400-2,100° F., which achieved up to 97% combustion efficiency. The measured emissions from the combustion chamber were 0-23 ppm NOx, 0-19 ppm SOx, 0-1.7% CO2, and particular matter of 0.45-1.19 lb/MM Btu, achieving a combustion efficiency of up to 97%.

A system and method implemented in accordance with the above disclosure provides significant opportunity for the clean disposal of biomass with the added advantage of power generation. The total number of farms in the U.S. producing poultry products, including broilers, breeders and egg layers is estimated at 99,700. Of this total, approximately 30,000 broiler farms account for 95% of broiler production in the U.S., with 6%-7% of broiler production generated in the Delaware-Maryland-Virginia region, with 2,700 broiler farms. The U.S. accounts for 20% of the world's broiler production, while European Union countries account for 12% (60% of U.S.). The current projections for both the small scale farm unit and a large scale regional unit configured as described above would generate energy to the grid that is currently estimated to be able to pay back the capital cost in 3.5 years. This does not include any environmental credits/funding, or the value of cost for bio-waste disposal.

Longer-term markets would include any agricultural industry where biomass is generated and must be disposed of in a clean, cost-efficient manner (including, by way of non-limiting example, pork and meat production industries, rice husk bio-mass, and post algal processed (oil-extracted) biomass). In addition, algae is an interesting source of bio-energy for its concentration of oil. Currently, after oil extraction, the remaining algal biomass can be dried and "pelletized" and used as fuel that is burned in industrial boilers and other power generation sources. The system and method described herein may be suitable to decrease costs of generating energy from the spent algal biomass, increasing the market potential for the technology.

Moreover, the system and method described herein are believed to provide significant improvement over conventional direct combustion technologies. For example, for bubbling fluidized bed combustion, high pressure air is fed through the bottom of the boiler with lower fluidization velocity which causes a bubbling effect and allows most of the bed material to be retained in the lower furnace. For circulating fluidized bed combustion, high-pressure air suspends the bed material and fuel particles, which can rise up the chamber into the cyclone. Heavy particles will fall into the cyclone hopper and be returned to the furnace to be used again. For swirling fluidized bed combustion, secondary air ports provide a swirling flow environment for combustion in an effort to increase the particle residence time and reduce unburned particles. However, the system and method employed in accordance with the invention provides multiple levels of secondary air injection nozzles, with optimized configurations for both primary air injection nozzles and secondary air injection nozzles, which features optimize the ability to control the combustion process and achieve higher combustion efficiencies (with resulting lower noxious emissions) than such previously known systems. As demonstrated in the initial test results (above), the system and method disclosed herein 1) provides efficient burning at controlled temperatures which reduces $NO_x$ and particulate emissions, 2) supplies sufficient secondary air and extended swirling air to burn fuels in the upper part of combustion chamber with high efficiency, 3) mixes fuel and combustion air quickly and uniformly, and 4) provides large gas-particle slip motion which prolongs particle residence time and allows a reduction in chamber size and thus the cost of the system.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A system for fluidized bed combustion, comprising:

a combustion chamber, said combustion chamber further comprising:

a primary air distribution and delivery system configured to provide vertical airflow through said combustion chamber, wherein said primary air distribution and delivery system further comprises a plurality of nozzles, each said nozzle comprising a semi-circular head, a cylindrical branch extending downward from said head, an outwardly extending lower branch having a widening diameter as said lower branch extends from said cylindrical branch, a plurality of first outlets extending horizontally outward from said cylindrical branch, and a plurality of second outlets extending angularly upward from said lower branch; and a secondary air distribution and delivery system configured to provide a plurality of vertically displaced, horizontally aligned, tangential airflows in said combustion chamber; and a biomass feeder in communication with an interior of said combustion chamber and positioned to deliver biomass material to said interior of said combustion chamber at a location above said primary air distribution and delivery system and below said secondary air distribution and delivery system.

2. The system of claim 1, further comprising a cyclone separator positioned downstream from said combustion chamber.

3. The system of claim 2, said cyclone separator having an air inlet configured to receive flue gas from said combustion chamber and fresh air from an air delivery system that supplies air to said primary air distribution and delivery system and said secondary air distribution and delivery system.

4. The system of claim 2, further comprising a heat exchanger positioned downstream from said combustion chamber, wherein said heat exchanger is in thermal communication with a thermal energy conversion device.

5. The system of claim 1, further comprising a mobile chassis, wherein said combustion chamber is mounted on said mobile chassis.

6. The system of claim 1, further comprising a monitoring and control system, said monitoring and control system further comprising:

a gaseous emissions monitor configured to detect levels of particulate matter and of monitored flue gases from said combustion chamber; and a processor having computer executable code configured to:

receive data from said gaseous emission monitor;

compare data received from said gaseous emissions monitor to alert levels of an amount of particulate matter and noxious gases in system flue gas; and in response to a determination that said amount of particulate matter or noxious gases in system flue gas exceed said alert levels, direct a control signal to at least said secondary air distribution and delivery system to vary airflow through said secondary air distribution and delivery system.

7. The system of claim 1, wherein said secondary air distribution and delivery system further comprises a plurality of vertically displaced, horizontally aligned sets of air injection nozzles.

8. The system of claim 7, wherein each set of air injection nozzles comprises a plurality of nozzles evenly spaced around an internal circumference of said combustion chamber.

9. The system of claim 8, wherein each air injection nozzle further comprises a first branch extending radially through a wall of said combustion chamber, and an internal branch configured at 90° to said first branch.

10. The system of claim 9, wherein said first branch comprises an inlet, an air inlet channel extending from said inlet to an interior, circular chamber, an interior flow channel extending from said circular chamber in a direction parallel to but not collinear with said air inlet channel, and a nozzle outlet extending at 90° from said interior flow channel and having a reducing diameter as said nozzle outlet extends from said interior flow channel.

11. The system of claim 8, wherein said system further comprises at least three of said sets of air injection nozzles.

12. A method for fluidized bed combustion, comprising the steps of:

providing a combustion chamber, said combustion chamber further comprising:

a primary air distribution and delivery system configured to provide vertical airflow through said combustion chamber, wherein said primary air distribution and delivery system further comprises a plurality of nozzles, each said nozzle comprising a semi-circular head, a cylindrical branch extending downward from said head, an outwardly extending lower branch having a widening diameter as said lower branch extends from said cylindrical branch, a plurality of first outlets extending horizontally outward from said cylindrical branch, and a plurality of second outlets extending angularly upward from said lower branch; and a secondary air distribution and delivery system configured to provide a plurality of vertically displaced, horizontally aligned, tangential airflows in said combustion chamber;

providing a biomass feeder in communication with an interior of said combustion chamber and positioned to deliver biomass material to said interior of said combustion chamber at a location above said primary air distribution and delivery system and below said secondary air distribution and delivery system;

directing biomass from said biomass feeder to said combustion chamber;

directing a vertical primary airflow into said combustion chamber and multiple, vertically displaced tangential airflows into said combustion chamber to create a swirling fluidized bed of biomass particles in said combustion chamber; and maintaining a biomass feed rate from said biomass feeder, a primary airflow rate from said primary airflow, and a secondary airflow rate from said tangential airflows sufficient to maintain a combustion efficiency of at least 90%.

13. The method of claim 12, further comprising:

providing a monitoring and control system, said monitoring and control system further comprising:

a gaseous emissions monitor configured to detect levels of particulate matter and of monitored flue gases from said combustion chamber; and a processor having computer executable code configured to:

receive data from said gaseous emission monitor;

compare data received from said gaseous emissions monitor to alert levels of an amount of particulate matter and noxious gases in system flue gas; and in response to a determination that said amount of particulate matter or noxious gases in system flue gas exceed said alert levels, direct a control signal to at least said secondary air distribution and delivery system to vary airflow through said secondary air distribution and delivery system; and modifying airflow through said secondary air distribution and delivery system to maintain combustion efficiency in said combustion chamber of at least 90%.

14. The method of claim 12, wherein said biomass has a moisture content of less than 35%.

15. The method of claim 12, further comprising the step of directing flue gas from said combustion chamber to a cyclone separator.

16. The method of claim 15, further comprising the step of directed flue gas from said cyclone separator to a heat exchanger in thermal communication with a thermal energy conversion device.

17. The method of claim 16, further comprising the step of directing flue gas from said heat exchanger to an exhaust system.

* * * * *